US010343211B2

(12) United States Patent
Kress et al.

(10) Patent No.: US 10,343,211 B2
(45) Date of Patent: Jul. 9, 2019

(54) THERMAL CAMERA SYSTEM FOR DIE-CAST MACHINE

(71) Applicant: Honda Motor Co., Ltd., Tokyo (JP)

(72) Inventors: Robert M Kress, Marysville, OH (US); Robert De Neff, Bellefontaine, OH (US)

(73) Assignee: Honda Motor Co., Ltd., Tokyo (JP)

( * ) Notice: Subject to any disclaimer, the term of this patent is extended or adjusted under 35 U.S.C. 154(b) by 104 days.

(21) Appl. No.: 15/246,820

(22) Filed: Aug. 25, 2016

(65) Prior Publication Data

US 2018/0056382 A1 Mar. 1, 2018

(51) Int. Cl.

*B22D 17/32* (2006.01)
*B22D 17/00* (2006.01)
*B22D 17/20* (2006.01)

(52) U.S. Cl.

CPC ..... *B22D 17/32* (2013.01); *B22D 17/002* (2013.01); *B22D 17/2007* (2013.01); *B22D 17/2015* (2013.01)

(58) Field of Classification Search

CPC .. B22D 17/32; B22D 17/002; B22D 17/2007; B22D 17/2015

See application file for complete search history.

(56) References Cited

U.S. PATENT DOCUMENTS 5,119,873 A * 6/1992 Yokoyama ..... B22D 17/32 164/155.3
5,631,465 A 5/1997 Shepard
5,711,603 A 1/1998 Ringermacher et al.
5,775,806 A 7/1998 Allred
6,013,915 A 1/2000 Watkins
6,192,968 B1 * 2/2001 Renkl ..... B05B 3/1014 164/121
6,367,968 B1 4/2002 Ringermacher et al.
6,690,016 B1 2/2004 Watkins et al.
7,304,297 B1 12/2007 King et al.
7,402,802 B1 * 7/2008 Terre ..... G01J 5/02 250/330

(Continued)

FOREIGN PATENT DOCUMENTS

WO 2013052383 A1 4/2013

OTHER PUBLICATIONS

Web page describing FLIR AnalyzIR Software, https://www.dotmed.com/listing/software/flir/analyzir-software/112737.

*Primary Examiner* — Kevin P Kerns
*Assistant Examiner* — Steven S Ha
(74) *Attorney, Agent, or Firm* — Honda Patents & Technologies North America, LLC; Mark E. Duell

(57) ABSTRACT

A die cast machine for producing a manufactured part includes a fixed die maintaining a fixed position in the die cast machine. The fixed die has an internal fixed die surface. A movable die moves from a first position to a second position in the die cast machine. The movable die has an internal movable die surface. A sprayer applies a die release agent to the internal fixed die surface and the internal movable die surface before operation of the die cast machine. A first thermal imaging apparatus takes thermal images of the fixed die, and a second thermal imaging apparatus takes thermal images of the movable die. Application of die release agent is controlled by the temperatures of the fixed and movable dies as determined by the thermal images.

11 Claims, 10 Drawing Sheets

(56) References Cited

U.S. PATENT DOCUMENTS

| | | | | |
|---|---|---|---|---|
| 7,507,965 | B2 | 3/2009 | Lane et al. | |
| 7,591,583 | B2 | 9/2009 | Foes et al. | |
| 8,244,488 | B2 | 8/2012 | Allen | |
| 8,450,686 | B1 | 5/2013 | Warnke et al. | |
| 2002/0018510 | A1 | 2/2002 | Murphy et al. | |
| 2004/0079113 | A1 | 4/2004 | Hegewald et al. | |
| 2010/0024887 | A1* | 2/2010 | Williams | F15D 1/00 137/2 |

* cited by examiner

SECTION A-A

THERMAL CAMERA SYSTEM FOR DIE-CAST MACHINE

TECHNICAL FIELD

The embodiments herein relate to the field of manufacturing machines, and more specifically for using thermal imaging cameras to monitor operating conditions.

BACKGROUND

Two die halves are used in die casting. One is a movable die that moves from one position to another, and the other is a fixed location die. Where the two dies meet is called the parting line. The fixed die contains the shot hole, which allows molten metal to flow into the dies. The movable die contains ejector pins and usually the gates, which are the pathways from the shot hole to the mold cavity. The mold cavity may consist of removable cavity inserts, which are separate pieces that can be replaced relatively easily and bolt into the die halves.

The dies are designed so that the finished casting will slide off the fixed half of the die and stay in the movable half as the dies are opened. This assures that the casting will be ejected every cycle because the movable half contains the ejector pins to push the casting out of that die half. The ejector pins are driven by an ejector plate, which accurately drives all of the pins at the same time and with the same force, so that the casting is not damaged. The ejector plate also retracts the pins after ejecting the casting to prepare for the next shot. There must be enough ejector pins to keep the overall force on each pin low, because the casting is still hot and can be damaged by excessive force. The pins still leave a mark, so they must be located in places where these marks will not hamper the casting's purpose.

A die release agent may be applied to the inside surfaces of the die between each shot. The die release agent prevents buildup of material on the die. This spray also causes some cooling of the die.

Other die components include cores and slides. Cores are components that usually produce holes or openings, but they can be used to create other details as well. There are two types of cores: fixed and movable. Fixed cores are ones that are oriented parallel to the pull direction of the dies (i.e. the direction the dies open); therefore they are fixed, or permanently attached to the die. Movable cores are ones that are oriented in any other way than parallel to the pull direction. These cores must be removed from the die cavity after the shot solidifies, but before the dies open, using a separate mechanism. Slides are similar to movable cores, except they are used to form undercut surfaces. Other features in the dies include water-cooling passages and vents along the parting lines. These vents are usually wide and thin (approximately 0.13 mm or 0.005 in) so that when the molten metal starts filling them the metal quickly solidifies and minimizes scrap. No risers are used because the high pressure ensures a continuous feed of metal from the shot.

Important material properties for the dies include thermal shock resistance and softening at elevated temperature, hardenability, machinability, heat checking resistance, weldability, availability (especially for larger dies), and cost. The longevity of a die is directly dependent on the temperature of the molten metal and the cycle time. The dies used in die casting are usually made out of hardened tool steels, because cast iron cannot withstand the high pressures involved, therefore the dies are very expensive, resulting in high start-up costs. Metals that are cast at higher temperatures require dies made from higher alloy steels. Due to the cost and difficulty of manufacturing dies, there is identified a need to manage and maximize the life cycle of the dies.

APPLICATION SUMMARY

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

According to one aspect, a die cast machine for producing a manufactured part includes a fixed die maintaining a fixed position in the die cast machine, the fixed die having an internal fixed die surface, a movable die moving from a first position to a second position in the die cast machine, the movable die having an internal movable die surface, a sprayer for applying a die release agent to the internal fixed die surface and the internal movable die surface before operation of the die cast machine, and at least one thermal imaging apparatus for taking a thermal image of the die cast machine.

According to another aspect, a method for managing the thermal properties of a die cast machine is disclosed. The die cast machine includes a fixed die maintaining a fixed position in the die cast machine, the fixed die having an internal fixed die surface, a movable die moving from a first position to a second position in the die cast machine, the movable die having an internal movable die surface, a sprayer for applying a die release agent to the internal fixed die surface and the internal movable die surface before operation of the die cast machine, a first thermal imaging apparatus for imaging the fixed die, and a second thermal imaging apparatus for imaging the movable die. The method includes the steps of imaging the fixed die to create a thermal image of the fixed die, imaging the movable die to create a thermal image of the movable die, calculating a first temperature of the fixed die based upon the thermal image of the fixed die, calculating a first temperature of the movable die based upon the thermal image of the movable die, spraying the internal fixed die surface with a first amount of the die release agent based upon the temperature of the fixed die, spraying the internal movable die surface with a second amount of the die release agent based upon the temperature of the movable die, moving the movable die into contact with the fixed die to create a closed die, injecting under pressure a liquefied metal into the closed die, cooling the fixed die and the movable die to create a manufactured part from the liquefied metal for a predefined amount of time, moving the movable die out of contact with the fixed die, and ejecting the manufactured part.

According to yet another aspect, a system for monitoring a manufacturing machine is disclosed. The manufacturing machine comprising a first component having a first internal surface, a second component moving from a first position to a second position in the manufacturing machine, the second component having a second internal surface, and an operational component for performing an operational process within the manufacturing machine. The system includes at least one thermal imaging apparatus for taking a thermal image of the manufacturing machine.

According to a further aspect, a method for managing the thermal properties of a machine is disclosed. The machine includes a first thermal imaging apparatus for imaging a first portion of the machine, and a second thermal imaging apparatus for imaging a second portion of the machine. The method includes the steps of imaging the first portion of the machine to create a first thermal image, imaging the second portion of the machine to create a second thermal image, calculating a first temperature of the first portion of the machine based upon the first thermal image, calculating a second temperature of the second portion of the machine based upon the second thermal image, cooling the first portion of the machine based on the first temperature, and cooling the second portion of the machine based on the second temperature.

The figures depict various embodiments of the embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

Figure 1:
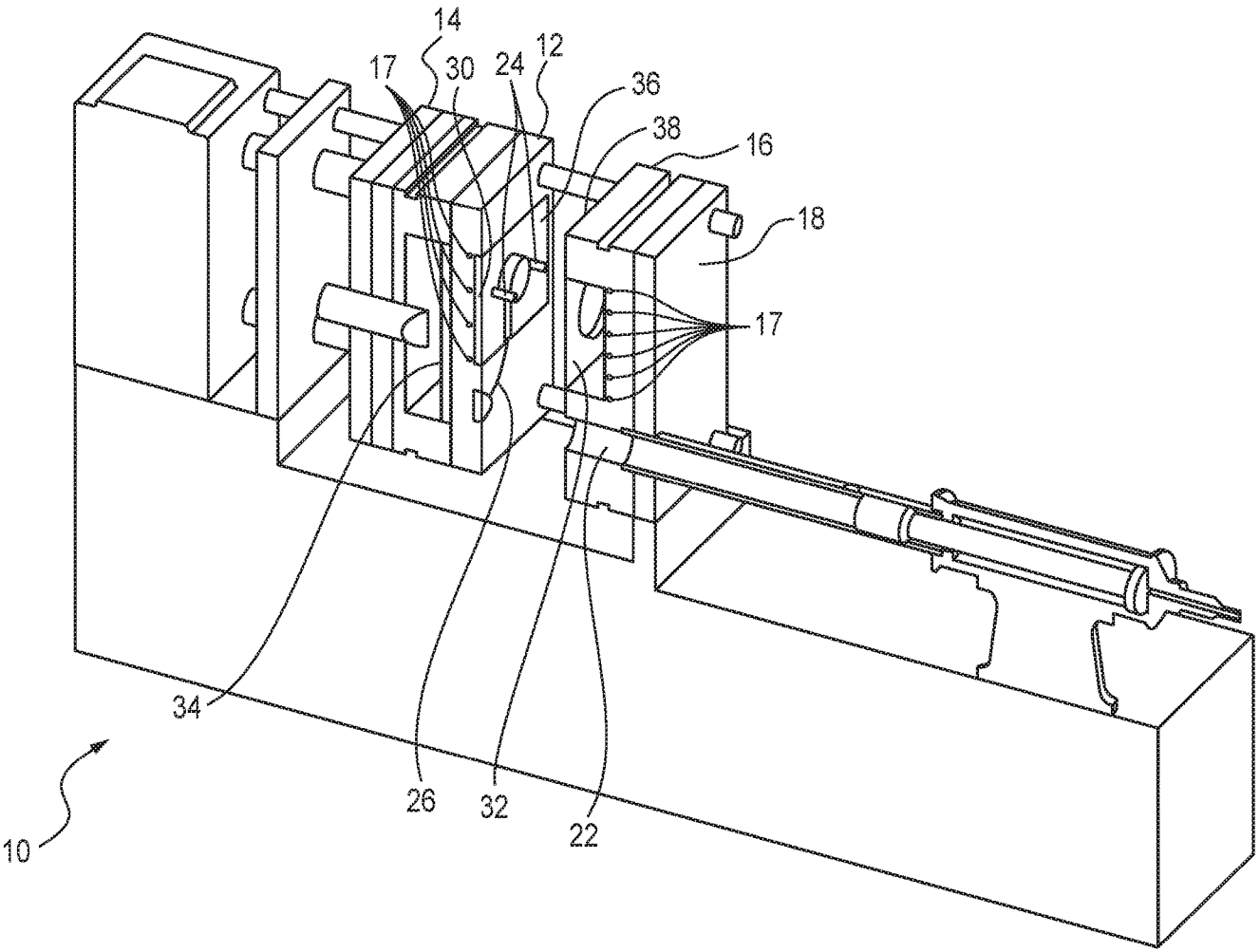
FIG. 1 is perspective view of a die cast machine with a movable die in an open position.
Figure 2:
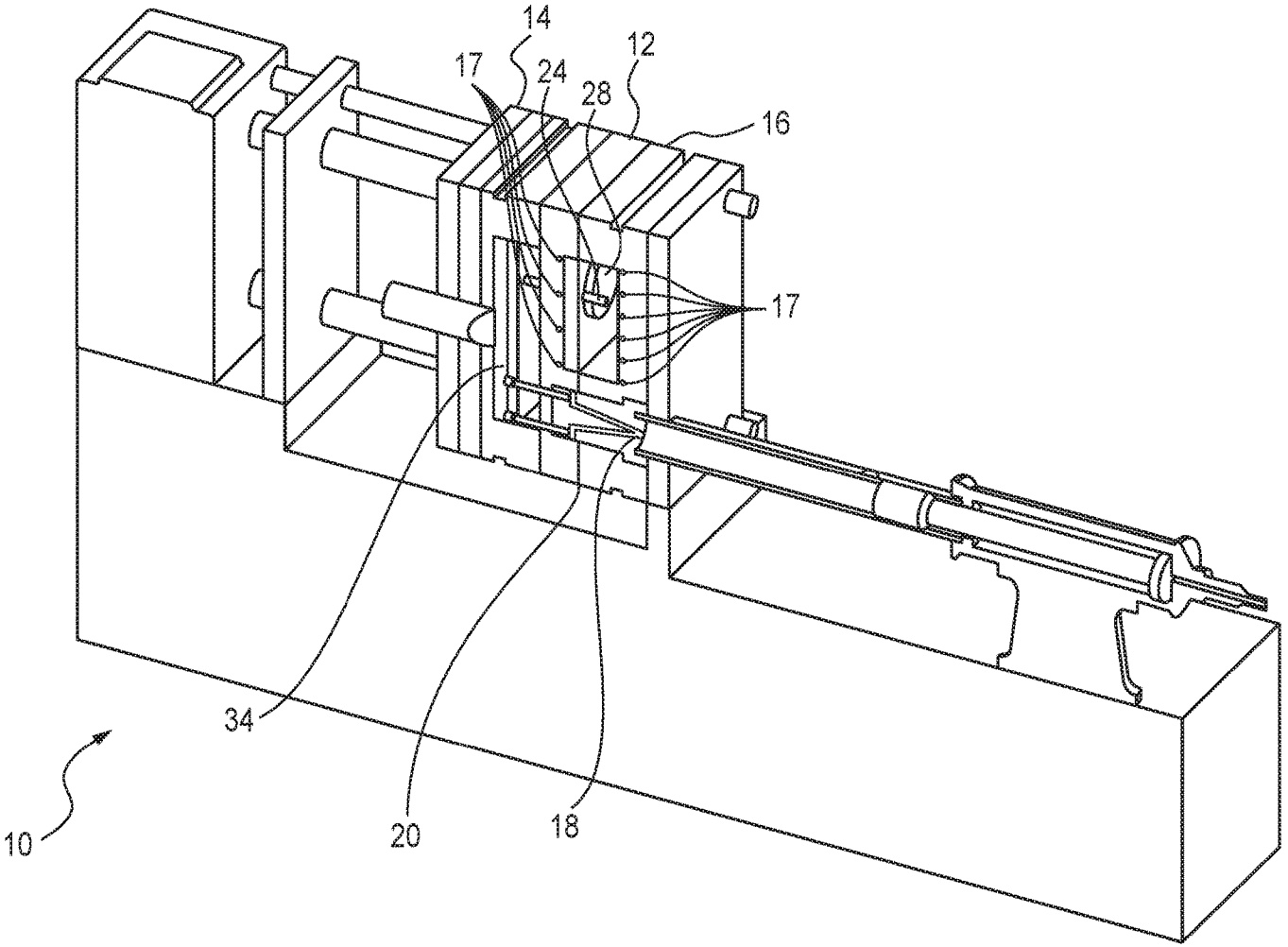
FIG. 2 is a perspective view of the die cast machine of claim 1 with the movable die in the closed position.

FIGS. 1 and 2 illustrate embodiments of a die cast machine 10. Two die halves 12, 16 are used in die casting. The first is a movable die 12 that is attached to a movable platen 14 and moves from an open position, as illustrated in FIG. 1, to a closed position, as illustrated in FIG. 2. The second is a fixed die 16 that remains fixed to a stationary platen 18 in a single location. Where the two dies 12, 16 meet is called the parting line 20. The fixed die 16 contains the shot hole 22, which allows molten metal to flow into the dies 12, 16 when the movable die 12 is in the closed position. A shot occurs when molten metal is injected into the closed die cast machine 10 and allowed to solidify. The movable die 12 further contains ejector pins 24 and the runner 26, which is the path from the shot hole 22 to the mold cavity 28. The mold cavity 28 is cut into two cavity inserts 30, 32, which are separate pieces that can be replaced relatively easily and bolt into the dies 12, 16.

Figure 6:
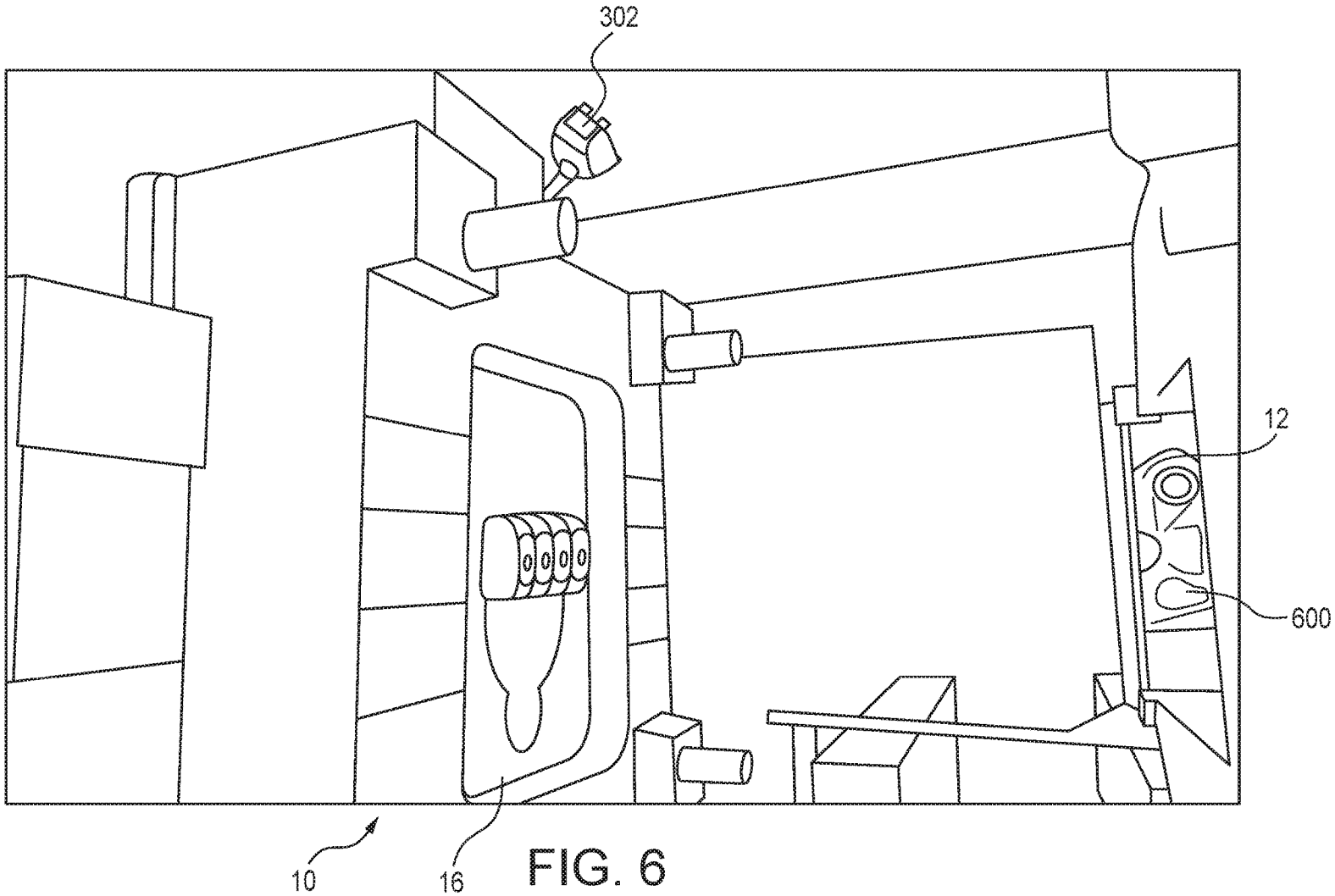
FIG. 6 is a perspective view of an embodiment of a die cast machine illustrating the thermal imaging camera mounting location.

The dies 12, 16 are designed so that the finished manufactured part, which in this embodiment is a casting 600, illustrated in FIG. 6, will slide off the fixed die 16 and stay in the movable die 12 as the movable dies 12 moves to the first position. This assures that the casting 600 is ejected every cycle because the movable die 12 contains the ejector pins 24 to push the casting 600 out of movable die 12. The ejector pins 24 are driven by an ejector pin plate 34, which accurately drives all of the pins 24 at the same time and with the same force, so that the casting 600 is not damaged. The ejector pin plate 34 also retracts the ejector pins 24 after ejecting the casting 600 to prepare for the next shot. The movable die 12 contains enough ejector pins 24 to keep the overall force on each pin low because the casting 600 is still hot enough to be damaged by excessive force at this point. The ejector pins 24 may still leave a mark so they must be located in places where these marks will not hamper the casting's purpose. As further illustrated in FIG. 3, a robot 310 may be used to remove the casting from the die cast machine 10, and a trim robot 312 may be used to trim any excess from the casting.

Other components for use with the dies 12, 16 include cores and slides (not shown). Cores are components that usually produce holes or openings, but they can be used to create other details as well. There are three types of cores: fixed, movable, and loose. Fixed cores are ones that are oriented parallel to the pull direction of the dies 12, 16 (i.e. the direction the dies open), therefore they are fixed, or permanently attached to the die casting machine 10. Movable cores are ones that are oriented in any other way than parallel to the pull direction. These cores must be removed from the die cavity 28 after the shot solidifies, but before the dies 12, 16 open, using a separate mechanism. Slides are similar to movable cores, except they are used to form undercut surfaces. Loose cores, also called pick-outs, are used to cast intricate features, such as threaded holes. These loose cores are inserted into the die casting machine 10 by hand before each cycle and then ejected with the part at the end of the cycle. The core then must be removed by hand. Loose cores are the most expensive type of core, because of the extra labor and increased cycle time. Other features in the dies 12, 16 include water-cooling channels 17 and vents (not shown) along the parting line 20. These vents are usually wide and thin (approximately 0.13 mm or 0.005 in) so that when the molten metal starts filling them the metal quickly solidifies and minimizes scrap.

Important material properties for the dies 12, 16 include thermal shock resistance and softening at elevated temperature, hardenability, machinability, heat checking resistance, and weldability. The longevity of a die 12, 16 is directly dependent on the temperature of the molten metal and the cycle time. The dies 12, 16 used in die casting are usually made out of hardened tool steels, because cast iron cannot withstand the high pressures involved. Therefore the dies 12, 16 are very expensive, resulting in high start-up costs. Metals that are cast at higher temperatures require dies 12, 16 made from higher alloy steels.

Figure 3:
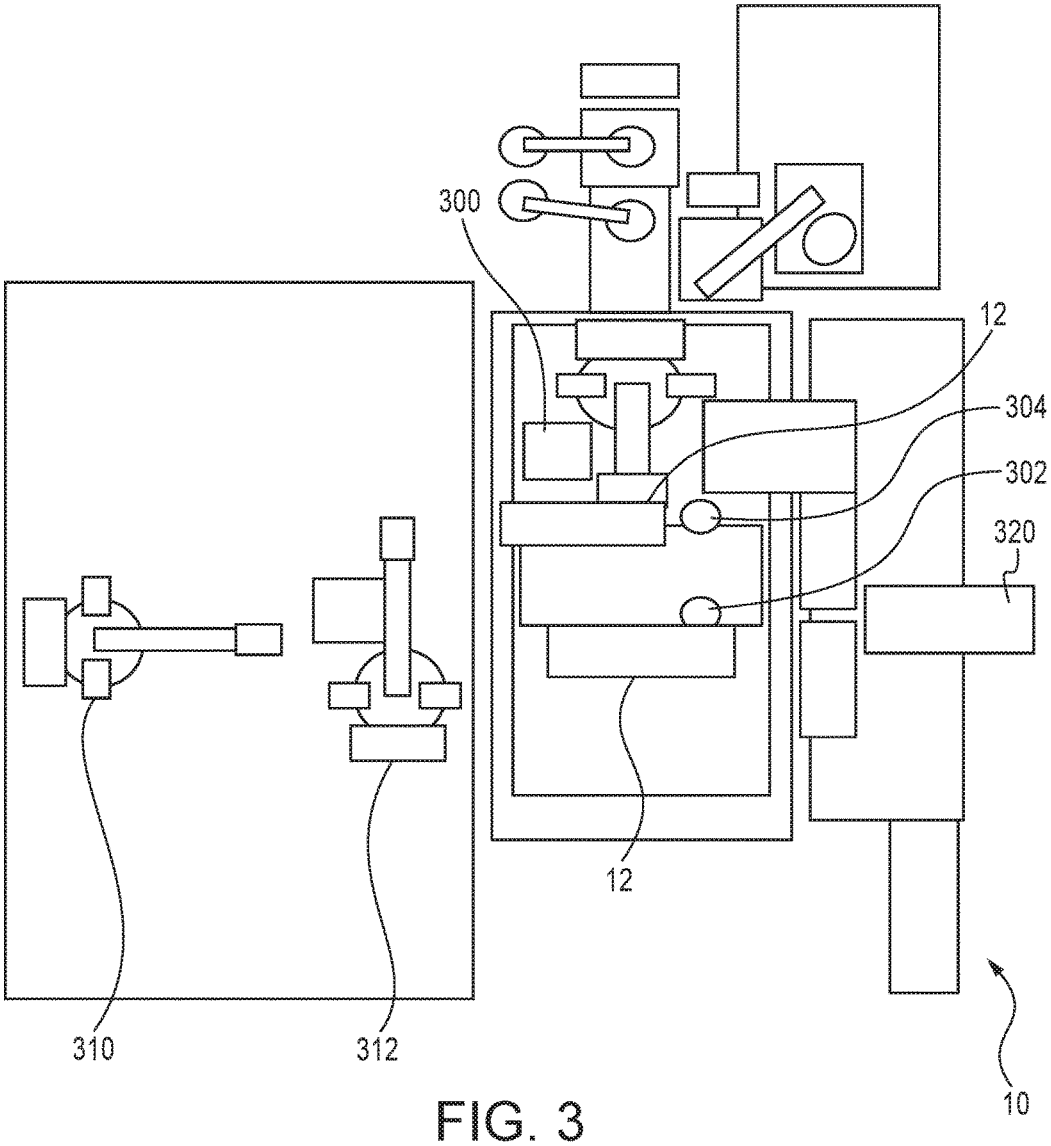
FIG. 3 is an overhead view of a schematic of an embodiment of a die cast machine.

A die release agent may be applied to the inside surfaces 36, 38 of the fixed die 16 and movable die 12 between each shot by a spray robot 300, as illustrated in the embodiment shown in FIG. 3. The die release agent prevents buildup of material on the dies 12, 16. This spray also causes some cooling of the dies 12, 16. The die release agent may be purposefully sprayed in areas where it is difficult to achieve cooling using cooling channels 17 within the dies 12, 16.

In order to manage the process of applying die release agent to the insides surfaces 36, 38 of the fixed die 16 and the movable die 12 between each shot, to manage the process of cooling the dies 12, 16, and to further manage the life cycle of the dies 12, 16, thermal imaging cameras 302, 304 are applied to the die cast machine 10. A first thermal imaging camera 302 is attached to the die cast machine 10 to take an image of the fixed die 16, and a second thermal imaging camera 304 is attached to the die cast machine 10 to take an image of the movable die 12.

Figure 4:
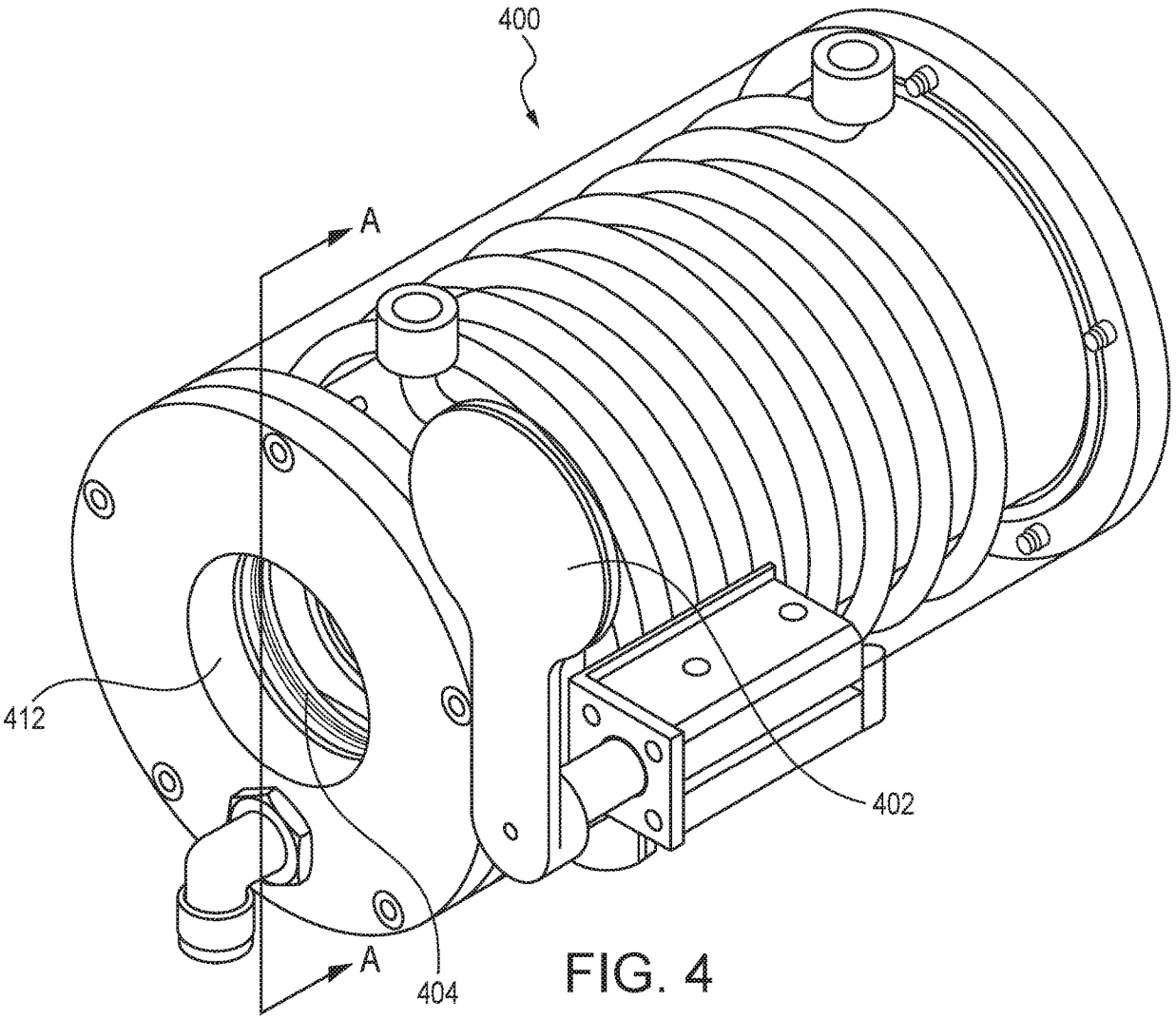
FIG. 4 is a perspective view of a thermal imaging camera enclosure.
Figure 5:
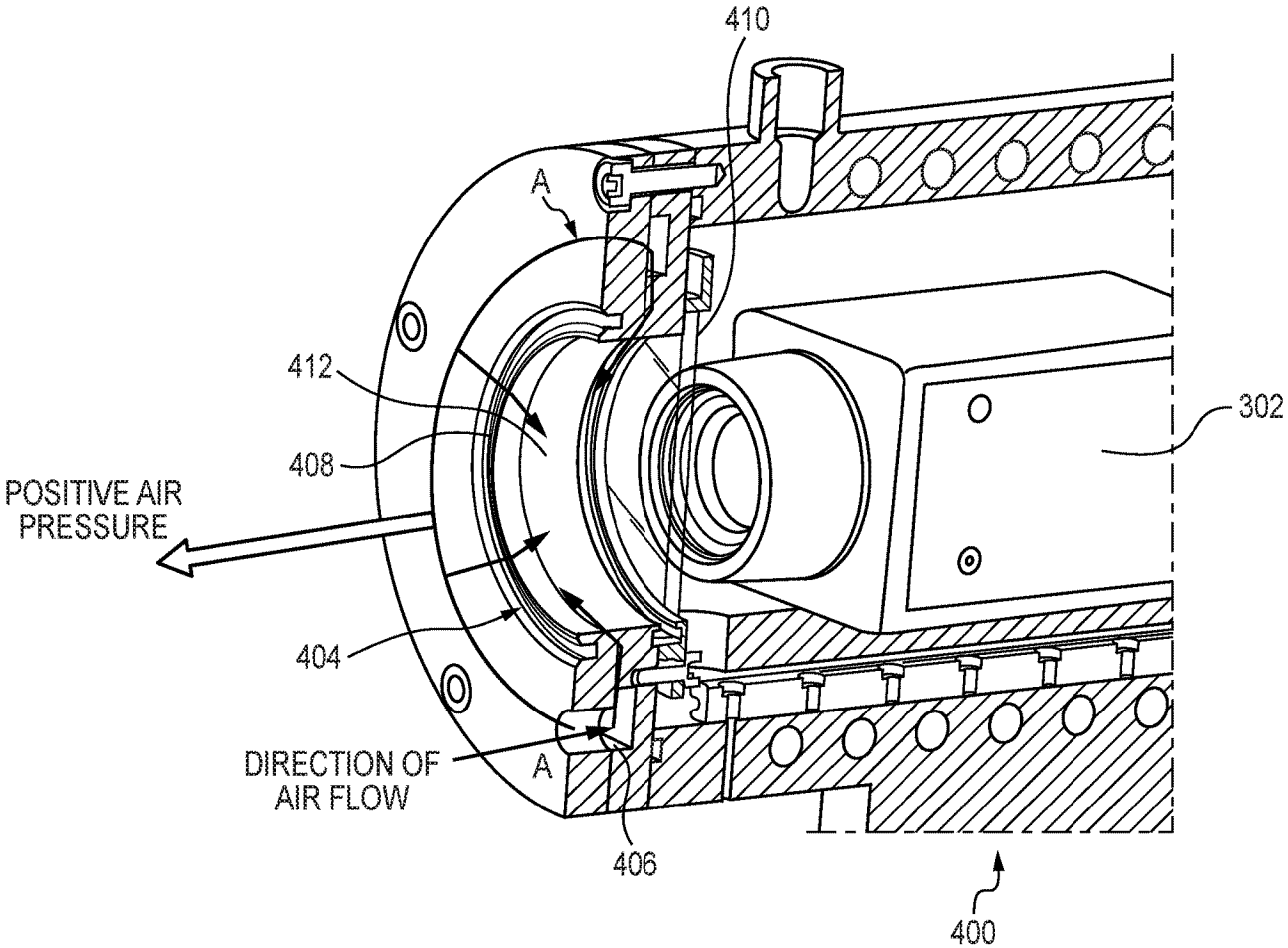
FIG. 5 is a perspective view of a cross section of the thermal imaging camera enclosure of FIG. 4 along line A-A.

The thermal imaging cameras 302, 304 are capable of making images identifying temperatures at least between 30° C. and 500° C. Each of the thermal imaging cameras 302, 304 is enclosed in a water-tight enclosure 400, illustrated in FIGS. 4-5, to prevent over-heating of the thermal imaging cameras 302, 304 in an ambient temperature of up to 500° C. The enclosure 400 is also equipped with a shutter 402, which is only opened to take an image, in order to block debris from the environment. The enclosure 400 also includes an air knife 404 to block debris from the environment from entering the shutter 402 when the shutter 402 is open to take an image. The air knife 404 prevents buildup of debris on the lens 410, such as a germanium lens, which is selected to withstand the high ambient temperatures of the environment. Positive air pressure is created as air follows a path indicated by Arrow A through a pathway 406 and out annular opening 408. The air pressure prevents debris from landing on the glass 410 when the shutter 402 is open. Operation of the air knife 404 may be limited to times when the shutter 402 is open. The shutter 402 covers the aperture when the thermal imaging cameras 302, 304 are not in use. The thermal imaging cameras 302, 304 are located to image the fixed die 16 and movable die 12 when the die cast machine 10 is between, and the movable die 12 is moved to its resting location as illustrated in FIG. 1. All processes of the die casting machine 10 are out of the image and all cores (not shown) will be in the out position. The images are taken without affecting the cycle time of the die cast machine 10. FIG. 6 shows one embodiment of a thermal imaging camera 302 mounted above the die cast machine 10 and angled to view the movable die 12 when the die cast machine 10 is between shots.

Using feedback from the die cast machine's 10 programmable logic controller 320, the thermal images can be saved with identifying data, including, but not limited to, current model, die, cast date, and shot number of that specific casting. In one embodiment, the identifying data may be a 16 digit serial number that is printed on the castings. Identification of the die cast machine 10 may also be added to the file name of the thermal image that is saved. These images will be saved in any suitable file format, such as a JPEG/JPG, GIF, PNG, TIFF, IMG, BMP, or other image file format. In one embodiment, the programmable logic controller 320 is a Mitsubishi QO6, although any functionally equivalent controller may be used.

In one embodiment, images will be saved in a specified model folder that is determined by which casting model, or product, is being produced. This file location will change automatically when a new casting model is loaded. The images will automatically overwrite the old images when a specified storage quota is met, which may be set based upon the available memory in the programmable logic controller. This will be done on a first-in, first-out basis.

Figure 10:
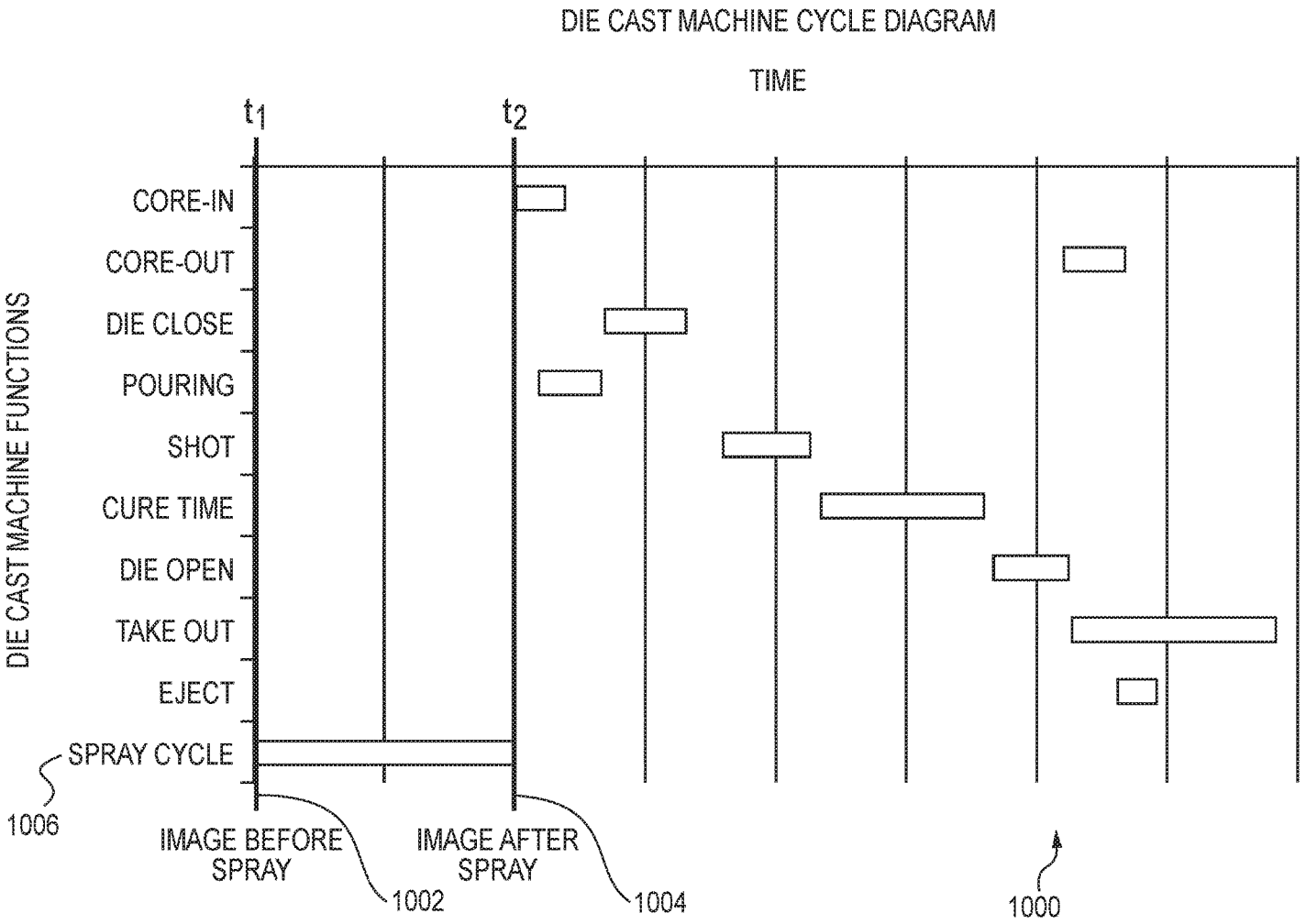
FIG. 10 is a diagram of an example of a die cast machine cycle.

Each casting model type will have pre-set Areas of Interest (AOI). FIG. 10 shows one embodiment of a cycle diagram 1000 of a die cast machine 10, with images taken two times in the cycle. The first image 1002 is taken at time $t_1$, which is the beginning of the cycle 1000. The second image 1004 is taken at a time $t_2$ at the end of the spray cycle 1006. These AOI will change to a different pre-set if a different casting model is loaded. The loading of a new model will be controlled by a series of binary outputs from the die casting machine 10 programmable logic controller 320. The AOI pre-sets will trigger an alarm if the temperatures as represented in the thermal images 1002, 1004 are out of the desired range. This alarm will be displayed on a screen, illuminate a light, and play the alarm tone on the programmable logic controller 320. If there are a predetermined number of consecutive alarms, such as 10 consecutive alarms, the die cast machine 10 will then stop.

Additionally, or alternatively, the user may be able to select AOIs using the Human Machine Interface (HMI) of the programmable logic controller 320 for each die cast machine 10. In one embodiment, the preferred HMI is GOT 1000 Series 1695, although any other functionally similar HMI may be used. The AOIs may be selected by positioning a circle, a rectangle, or a free-form shape drawn using a "pencil" tool, a point and click device, a touch to a touch screen, or by any other suitable method known to those skilled in the art, on a thermal image to define the AOI.

The HMI software was written to use a Generic Interface for Cameras (GenICam™) programming interface to control the cameras 302, 304. GenICam™ is an industry standard generic programming interface for controlling a wide variety of cameras and other sensors, including the cameras 302, 304 of the cameras disclosed in the embodiments herein. GenICam™ software may be used with electro-optic (EO) cameras and thermal cameras, such as those produced by FLIR® Systems. By using the GenICam™ protocol in the programmable logic controller 320, any thermal cameras 302, 304 that are GenICam™ compliant may be utilized.

Figure 7:
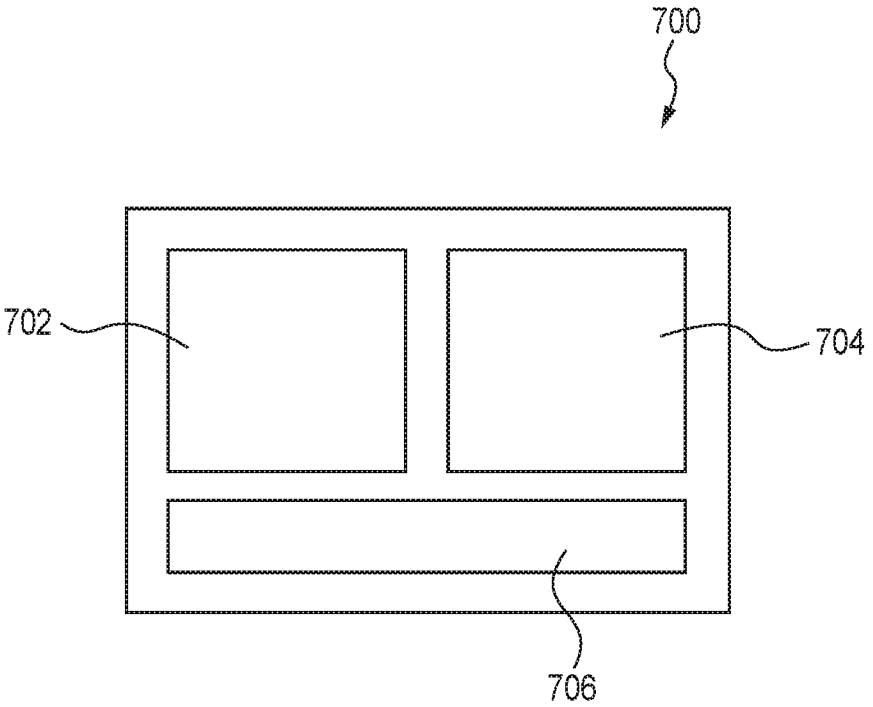
FIG. 7 is a view of the screen of a programmable logic controller.
Figure 9:
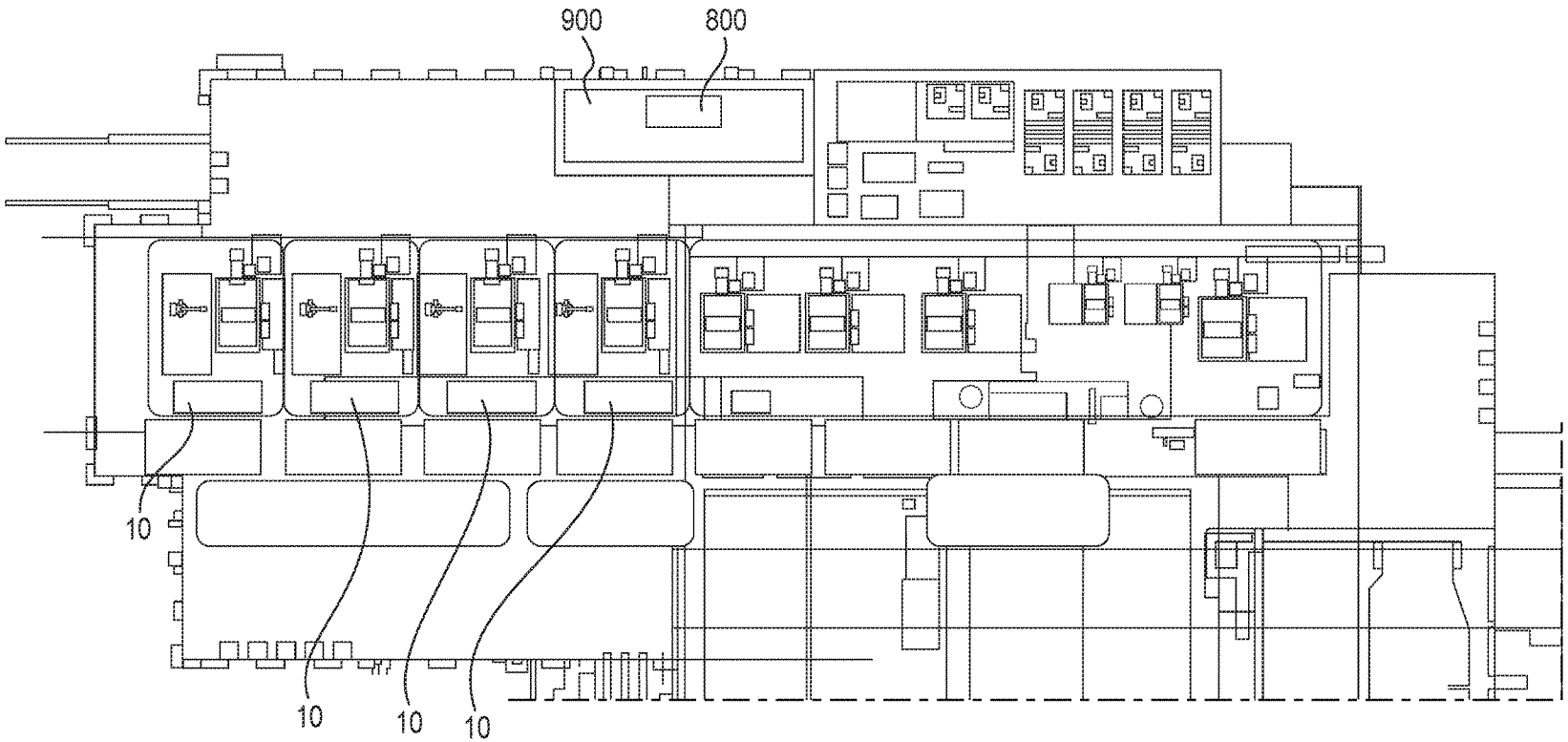
FIG. 9 is an overhead view of schematic of a manufacturing facility having more than one die cast machine.

In one embodiment, an integrated display 700, illustrated in FIG. 7, is located on each programmable logic controller 320 of a series of die cast machines 10, illustrated in FIG. 9. The integrated display shows real-time thermal images 702 of the fixed die 16, and real-time thermal images 704 of the movable die 12. A trend chart 706 is displayed on display 700 showing fluctuations, over time, of the temperature of the dies 12, 16. The flow of images is automatically updated on a first in, first out basis.

Figure 8:
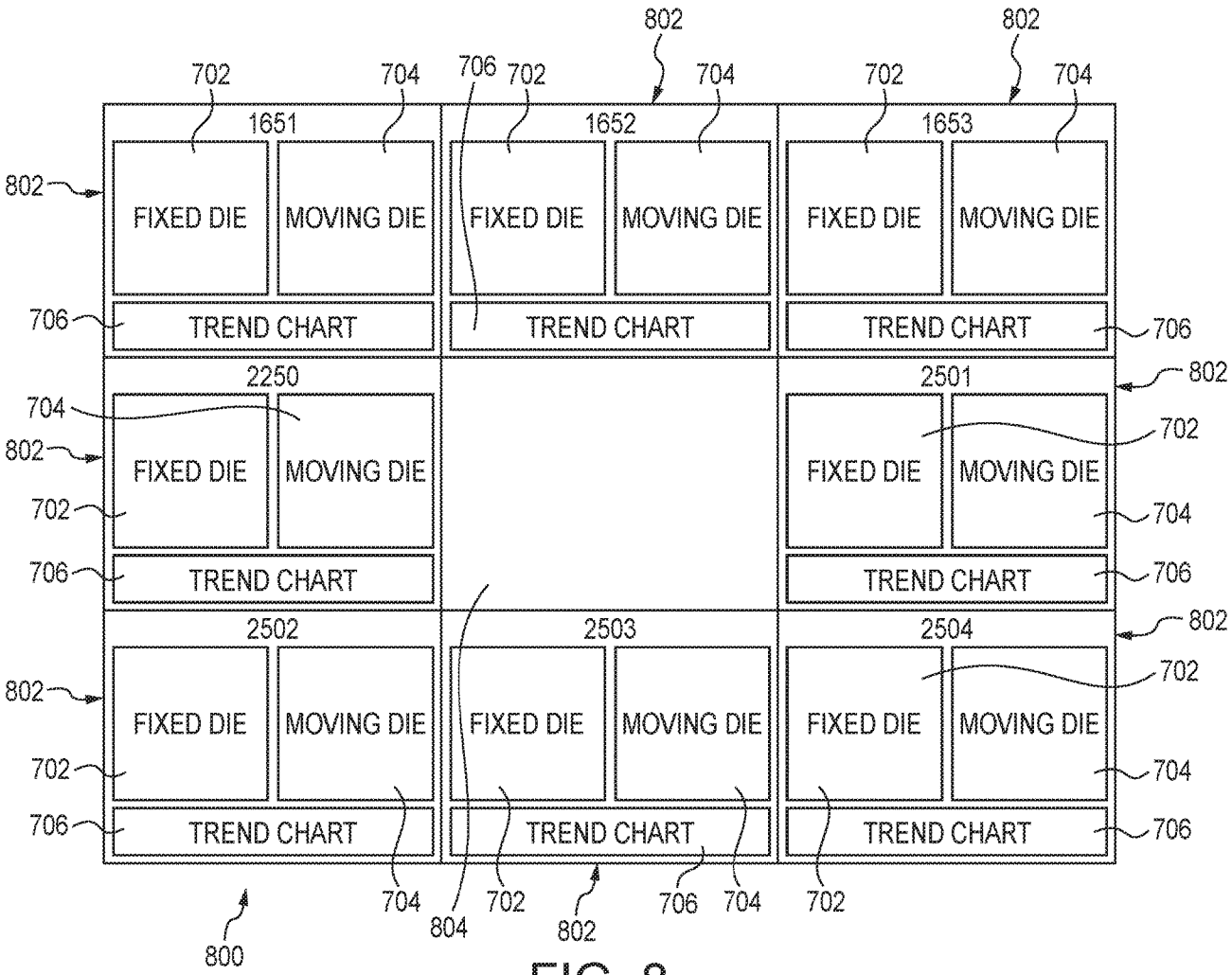
FIG. 8 is a view of an integrated display.

One large screen display 800, illustrated in FIG. 9, is mounted in a Quality Control Room 900 that will display thermal images of all of the die cast machines 10. These images will be automatically updated with the most current images 702, 704 taken for each of the die cast machines 10. The large screen display is divided into 9 boxes 802, as illustrated in FIG. 8. Each box 802 will display one integrated display 700 for each die cast machine 10. A thermal image 702 of the fixed die 16 and a thermal image 704 of the movable die 12 for each die cast machine 10 will be displayed in one box. The center box 804 is reserved for special information or data as is necessary. The large screen display 800 refreshes with every thermal image 702, 704 taken. Trends showing the temperature fluctuations for each die cast machine 10 are displayed in trend charts 706 in each box 802.

Thermal images 702, 704 are used to identify when process parameters (e.g., die temperature) are outside of predefined thresholds, to determine the thresholds that create the most desirable parts, and/or to troubleshoot the cause of defective parts. More specifically, the thermal images 702, 704 generated "before spray" 1002 are used to identify issues with the spray nozzles and/or die release agent delivery lines of the spray robot 300. The thermal images 702, 704 generated "after spray" 1004 are used to identify if the dies 12, 16 are at the optimum temperature to perform the next shot. Further, the thermal images 702, 704 may be used for dynamic heating or cooling of the dies 12, 16. Thermal images 702, 704 may be used to identify areas of the dies 12, 16 that are hotter or colder than desired, and the flow of die release agent may be increased or decreased as necessary in the identified areas to raise or lower the temperature of those areas based upon feedback from the thermal images 702, 704. Additionally, the flow of die cooling liquid may be increased or decreased in areas of the dies 12, 16 that are hotter or cooler than desired, so long as the amount of die release agent applied to the cool areas is not less than is needed for the die release agent to properly function. Die cooling may be from the external application of die release agent or internal flow of coolants, the combinations of which may vary based on the construction of the dies 12, 16, operating conditions, operating frequency, materials, and other factors known to those skilled in the art.

While the embodiments discussed herein have been directed to die cast machines 10, other industrial machines that are subjected to thermal stresses and temperature tolerances may use the thermal imaging cameras 302, 304 to monitor the thermal properties of the machines or portions of the machines. Such machines may include, but are not limited to, stamping machines, forging machines, and other types of casting machines. The monitoring of the thermal stresses and tolerances may be used to change the operating conditions of any associated components, including sprayers, coolers, or other components that may be associated with the machine.

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "determining" or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware or hardware, and when embodied in software, could be downloaded to reside on and be operated from different platforms used by a variety of operating systems. The embodiments can also be in a computer program product which can be executed on a computing system.

The embodiments also relate to an apparatus for performing the operations herein. This apparatus may be specially constructed for the purposes, e.g., a specific computer, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for disclosure of enablement and best mode.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments as defined in the appended claims.

What is claimed is:

1. A die cast system for producing a manufactured part, comprising:

a die cast machine, comprising:

a fixed die configured to maintain a fixed position in the die cast machine, the fixed die having an internal fixed die surface;

a movable die configured to move from a first position adjacent to the fixed die to a second position spaced apart from the fixed die in the die cast machine, the movable die having an internal movable die surface;

a sprayer for applying a die release agent to the internal fixed die surface and the internal movable die surface before operation of the die cast machine;

a first thermal imaging apparatus disposed in the die cast machine and configured to face the internal fixed dies surface of the fixed die for taking a first thermal image of the internal fixed die surface of the fixed die; and a second thermal imaging apparatus disposed in the die cast machine and configured to face the internal movable die surface of the movable die for taking a second thermal image of the internal movable die surface of the movable die in the second position, the second thermal imaging apparatus and the first thermal imaging apparatus being connected to a programmable logic controller and further configured to capture images at specified times; and wherein the sprayer is configured to apply the die release agent based upon the first thermal image and the second thermal image.

2. The die cast system of claim 1 further comprising:

the programmable logic controller having a display screen, wherein the image of the fixed die and the image of the movable die are displayed on the display screen.

3. The die cast system of claim 2 further comprising:

a first enclosure encapsulating the first thermal imaging apparatus and separate from the first thermal imaging apparatus for protecting the first thermal imaging apparatus, the first enclosure comprising:

a shutter that moves from an open position to a closed position over an opening in the first enclosure;

a clear pane covering the opening; and an air knife to prevent debris from entering the opening when the shutter is in an open position, the air knife comprising:

an annular channel around the opening;

a passageway delivering pressurized air to the annular channel; and wherein the pressurized air passes through the annular channel into the opening, thereby preventing debris from entering the opening.

4. The die cast system of claim 3 further comprising:

a second enclosure encapsulating the second thermal imaging apparatus and separate from the second thermal imaging apparatus for protecting the second thermal imaging apparatus, the second enclosure comprising:

a shutter that moves from an open position to a closed position over an opening in the second enclosure;

a clear pane covering the opening; and an air knife to prevent debris from entering the opening when the shutter is in an open position, the air knife comprising:

an annular channel around the opening;

a passageway delivering pressurized air to the annular channel; and wherein the pressurized air passes through the annular channel into the opening, thereby preventing debris from entering the opening.

5. The die cast system of claim 4 wherein the first thermal imaging apparatus is mounted on the movable die.

6. The die cast system of claim 5 wherein the second thermal imaging apparatus is mounted on the fixed die.

7. A die cast machine for producing a manufactured part, comprising:

a fixed die affixed to the die cast machine in a fixed position in the die cast machine, the fixed die having an internal fixed die surface;

a movable die configured to move from a first position adjacent to the fixed die to a second position spaced apart from the fixed die in the die cast machine, the movable die having an internal movable die surface;

a sprayer configured to apply a die release agent to the internal fixed die surface and the internal movable die surface before operation of the die cast machine;

a first thermal imaging apparatus mounted to the movable die and oriented toward the fixed die surface for taking a first thermal image of the internal fixed die surface of the fixed die;

a second thermal imaging apparatus mounted to the fixed die and oriented toward the second position of the movable die for taking a second thermal image of the internal movable die surface of the movable die;

a programmable logic controller operatively connected to the first and second thermal imaging apparatuses and the sprayer, the programmable logic controller configured to operate the first and second thermal imaging apparatuses to capture the first and second thermal images at specified times and calculating a first component temperature based upon the first thermal image and a second component temperature based upon the second thermal image, wherein the sprayer is configured to be adjusted by the programmable logic controller to apply the die release agent based upon the first component temperature and the second component temperature.

8. The die cast machine of claim 7 further comprising:

a display screen in electronic communication with the programmable logic controller, wherein the first thermal image of the fixed die and the second thermal image of the movable die are displayed on the display screen.

9. The die cast machine of claim 8 further comprising:

an alarm operable by and in communication with the programmable logic controller.

10. The die cast machine of claim 7 further comprising:

a first enclosure mounted to the movable die for protecting the first thermal imaging apparatus, the first enclosure comprising:

a shutter that moves from an open position to a closed position over an opening in the first enclosure;

a clear pane covering the opening; and an air knife to prevent debris from entering the opening when the shutter is in an open position, the air knife comprising:

an annular channel around the opening;

a passageway delivering pressurized air to the annular channel; and wherein the pressurized air passes through the annular channel into the opening, thereby preventing debris from entering the opening.

11. The die cast machine of claim 10 further comprising:

a second enclosure mounted to the fixed die for protecting the second thermal imaging apparatus, the second enclosure comprising:

a shutter that moves from an open position to a closed position over an opening in the second enclosure;

a clear pane covering the opening; and an air knife to prevent debris from entering the opening when the shutter is in an open position, the air knife comprising:

an annular channel around the opening;

a passageway delivering pressurized air to the annular channel; and wherein the pressurized air passes through the annular channel into the opening, thereby preventing debris from entering the opening.

* * * * *